United States Patent [19]

Moll et al.

[11] 4,429,038

[45] Jan. 31, 1984

[54] PROCESS FOR CONCENTRATING YELLOW SILVER SOLS

[75] Inventors: Franz Moll; Ingeborg Höll, both of Leverkusen, Fed. Rep. of Germany

[73] Assignee: Agfa Gevaert Aktiengesellschaft, Leverkusen-Bayerwerk, Fed. Rep. of Germany

[21] Appl. No.: 401,653

[22] Filed: Jul. 26, 1982

[30] Foreign Application Priority Data

Jul. 31, 1981 [DE] Fed. Rep. of Germany ..... 3130345

[51] Int. Cl.[3] ..... G03C 1/84; G03C 1/05

[52] U.S. Cl. ..... 430/510; 106/125; 106/135; 75/118 P; 430/512; 430/513

[58] Field of Search ..... 106/125, 135; 430/510, 430/512, 513, 514–516; 75/118

[56] References Cited

U.S. PATENT DOCUMENTS

| | | | |
|---|---|---|---|
| 2,806,798 | 9/1957 | Weaver | 430/510 |
| 3,459,563 | 8/1969 | Terashima et al. | 430/510 |
| 3,615,789 | 10/1971 | Schaller | 106/135 |
| 3,655,412 | 4/1972 | Kumai et al. | 106/135 |
| 4,094,811 | 6/1978 | Botta et al. | 430/510 |

*Primary Examiner*—Mary F. Downey

*Attorney, Agent, or Firm*—Connolly and Hutz

[57] ABSTRACT

A yellow silver sol containing a binder is concentrated by flocculation in the presence of a calcium-free gelatin, a water-soluble chloride being added to the flocculation and/or after the redispersion.

4 Claims, 1 Drawing Figure

PROCESS FOR CONCENTRATING YELLOW SILVER SOLS

Figure 1:
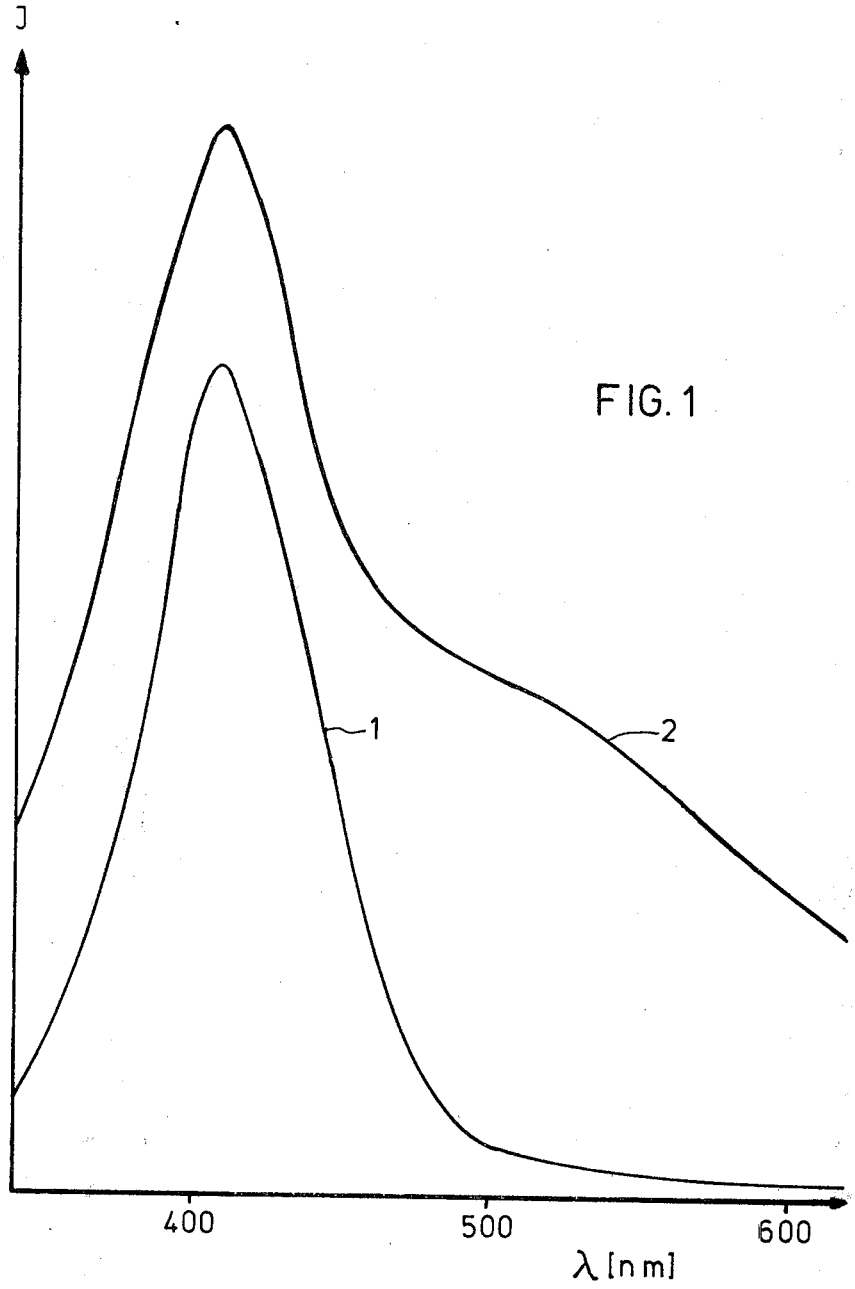

This invention relates to a process for concentrating yellow silver sols. It is known that undesirable light absorption in photographic silver halide materials can be prevented by using suitable filter layers. The structure of many colour photographic materials is, for example, the following: on a substrate is positioned a red-sensitive bottom layer producing a cyan dye image, positioned thereon is a green-sensitive middle layer producing a magenta dye image, and in the uppermost layer, a blue-sensitive top layer which produces a yellow dye image. A yellow-coloured filter layer is usually positioned between the top and middle layers, which filter layer prevents a blue-light exposure of the underlying layers which, like the top layer, have a blue intrinsic sensitivity. The dye of this yellow filter layer may be of an organic or inorganic nature. Yellow silver sols, i.e., colloidal silver dispersed in a binder, are preferably used for a yellow filter layer of this type, because they may be easily removed during photographic processing. When used in a yellow filter layer, the silver sols must strongly absorb in the absorption range of the silver halide, but they must not impair the green-sensitivity of the magenta layer and of course they must also not impair the red-sensitivity of the cyan layer. The sensitivity of the green-sensitive layer generally commences at 480 nm, so that an absorption of the silver sol in this range is already noticeably disturbing. Unfortunately, most yellow silver sols have a more or less considerable absorption in the sensitization range of the green-sensitive layer.

It has been shown that the ratio F of the absorption intensity of the yellow silver sol, measured in liquid form, at 470 nm to the absorption intensity at the maximum absorption is a good gauge for the utility of the yellow silver sol. The lower this factor F, the more favourable the silver sol. It is shown in practice that materials having values greater than 0.2 can no longer be used, because otherwise the sensitivity of the magenta coating is already depressed too considerably.

Silver sols which have a suitable absorption behaviour usually have an absorption maximum of from 400 to 410 nm and steeply falling absorption flanks, in particular towards longer wavelengths. However, the preparation of such silver sols is associated with considerable difficulties, because the yellow colour of the silver sol is easily changed by electrolytes (see "Gmelins Handbuch der anorganischen Chemie", 1980, Volume Ag (A3) 61, page 192 ff). It is stated at the bottom of page 192 that silver sols having gelatine as the protective colloid are destroyed rapidly by chlorides and slowly by sulphates. It is stated on page 201 that by adding ammonium chloride and sodium chloride, the yellow colour is changed or the sol coagulates in the presence of an electrolyte and cannot be stored. It is obvious that discoloured yellow silver sols can no longer be used in yellow filter layers.

Thus, it has already been explained in British Pat. No. 739,851 that it is very difficult to produce a yellow silver sol, because the colour thereof readily changes into brown-orange or black.

Nevertheless, yellow silver sols are used extensively in yellow filter layers, because they may be easily removed during processing and they allow thinner filter layers compared to yellow dyes. However, an improved sharpness may be obtained by thinner layers. Yellow silver sols were previously prepared by reducing a silver salt in the presence of a suitable binder which could, however, also be added after the reduction. A particularly suitable binder was and still is gelatin. In order to free from impurities the yellow silver sols thus prepared, it was previously common practice to set the emulsion by cooling, to cut it into small pieces, into so-called "noodles" and to wash it out with running water. The solidified emulsion could be re-liquefied by heating.

Cleaning processes of this type have several disadvantages, being in particular time-consuming and requiring large quantities of wash water. However, above all, it is impossible to obtain concentrated silver sols by such processes. Concentrated silver sols are, however, required for the production of particularly thin filter layers which, as specified above, allow a particularly good sharpness.

It is only possible to prepare concentrated silver sols at a commercially justifiable expense by the so-called flocculation process. Such flocculation processes are known in the preparation of silver halide dispersions, as is the use thereof in the preparation of silver sols. In flocculation processes, the binder, generally gelatin, is precipitated with suitable substances, for example, alcohol or with high concentrations of inorganic salts. Another possibility is to use a chemically modified gelatine which is sparingly soluble in the acidic medium. In this case, for example, when using 10% of an acylated gelatine, all of the gelatin may be flocculated at a pH of 3. The gelatin may also be coagulated in the acidic pH range by the formation of coacervates with polymeric organic compounds which contain sulpho or carboxyl groups. Suitable polymers include, for example, polyesters of sulphosuccinic acid or polystyrene sulphonic acid.

The flocculated gelatin may be easily purified by repeatedly washing and decanting the flocky deposit. Redispersion is possible by increasing the pH, the original emulsion being re-prepared. A survey of this process is provided, for example, in Ullmanns EnzyklopUML /a/die der technischen Chemie, 4th edition, volume 18, 1979, page 423.

However, particular difficulties arise when such flocculation processes are used for the preparation of silver sols. In some cases, the silver sol is so fine-grained that it is only partly retained by the gelatin used as a binder and there are high losses during flocculation. Furthermore, colour changes readily occur during redispersion, as specified, for example, in British Pat. No. 1,152,506.

In order to prevent such colour changes, it is proposed in British Pat. No. 1,152,506 to carry out flocculation using very specific flocculents and to carry out the redispersion in the presence of citrate ions. A disadvantage of this process is the fact that the conventional, tried and tested flocculents cannot be used.

An object of the present invention is to provide an improved process for the preparation and concentration of yellow silver sols. In particular, a process is to be provided by which highly-concentrated silver sols may be prepared which are stable and do not undergo any colour changes. Furthermore, it should be possible to use the conventional flocculation processes.

A process for concentrating a yellow silver sol which contains a binder and which is flocculated, washed and redispersed has now been found. Flocculation is carried out according to the present invention in the presence of gelatin which is free of calcium. Furthermore, the flocculation operation and/or redispersion takes place in the presence of from 0.05 to 0.7 mols of a water-soluble chloride per mol of silver which is used.

The yellow silver sol which is to be concentrated may be prepared according to processes known per se, for example, by reducing a water-soluble silver salt, preferably silver nitrate. For this purpose, conventional reducing agents may be used, for example, hydrazine, the amino boranes known from British Pat. No. 1,032,871, dextrin and ethylenediaminetetraacetic acid etc. The reduction itself may take place in an aqueous solution or already in a binder, preferably gelatin, but also in the presence of starch, gum arabic, pectin, or polyvinyl alcohol etc.

A gelatin which is free of calcium is generally already used as a binder during reduction and is to be added at the latest to the flocculation. The term "a gelatin free of calcium" is understood to mean a gelatin of which the maximum calcium content amounts to 0.05% by weight. Such gelatines are known, for example, from "The Science and Technology of Gelatin" A. G. Ward and A. Courts, Academic Press 1977, chapter 10, page 324, line 26.

The calcium-free gelatine is added in such a quantity that it is present during floccuation in a concentration of from 0.25 to 5%, based on the total volume, preferably from 0.5 to 3%. The quantity of gelatin based on the silver which is present calculated as $AgNO_3$ is from 30 to 300 g/mol $AgNO_3$, preferably from 50 to 100 g of gelatin/mol of $AgNO_3$.

The unrequired compounds which are present after the preparation of the sol are separated according to the flocculation processes which are conventional in photographic emulsion technique. For example, a gelatin may be added which has been chemically reacted with acetyl, propionyl or other acyl groups, as described, for example, in U.S. Pat. No. 2,956,880. Furthermore, unreacted gelatin may also be added and the gelatin may be flocculated by anion-active substances, for example, dodecyl sulphate, as described in Belgian Pat. No. 586,242. In a preferred embodiment, flocculation is carried out by adding polystyrene sulphonic acid, as described, for example, in German Auslegeschrift No. 1,085,422.

The silver sol is adjusted to pH values generally from 6 to 3 using the flocculents, all the gelatin coagulating and precipitating together with the silver sol. The remaining solution may be decanted and the precipitate may be washed as often as required. The redispersion may be obtained by adding an alkaline solution, for example of NaOH, and by heating. The viscosity and the gelatine/silver ratio may be varied within wide limits by adding water and gelatine or another binder. The pAg value of the silver sol emulsion may be adjusted to the required values, for example from +10 mV to +200 mV, preferably from +100 to +150 mV using a water-soluble chloride.

The chloride to be used according to the present invention is a water-soluble chloride, preferably ammonium or an alkali metal chloride. Sodium chloride is particularly preferred. The chloride is generally added at the latest to the flocculation. The concentration which is used is from 0.05 to 0.7 mol per mol of silver sol. However, it is also possible to add the chloride only to the redispersion or immediately after the redispersion. In this case, from $10^{-1}$ to $10^{-2}$ mol of chloride per mol of silver sol are added.

In contrast to the initially mentioned references, the present invention, by the use of sodium chloride, provides a silver sol which is unchanged and stable for months and is outstandingly suitable for use in yellow filter layers in photographic materials.

EXAMPLES

Example 1

A yellow silver sol is prepared by slowly adding a silver nitrate solution to an alkaline dextrin solution. After reduction, 0.3 mols of sodium chloride per mol of silver nitrate are added to the dispersion. The solution is also mixed with a de-salted, calcium-free gelatin, so that the ratio of gelatine to silver, calculated as silver nitrate, amounts to 0.4. 10% by weight of polyvinyl sulphonic acid, based on the gelatin, is added to the dispersion in the form of an aqueous solution as a flocculent. The dispersion is adjusted to pH 3.5 using sulphuric acid and it flocculates. The remaining aqueous solution is decanted and more water is added. The mixture is stirred for a few minutes, decanted and the washing process is repeated. The flocculated material is then adjusted to pH 6.5 by heating, during which it redissolves. By adding water and gelatin the ratio of gelatin to silver, calculated as silver nitrate, is adjusted to 1.0. The viscosity is 40 mPas. The pAg value, measured with a silver electrode against a saturated calomel electrode, is brought to +40 mV using sodium chloride. The absorption curve of the resulting silver sol in a liquid, dilute solution is illustrated in FIG. 1 (curve 1). The F factor defined above is 0.13.

Example 2

(Comparative Example)

The process is carried out as specified in Example 1 except that sodium chloride is not added. Curve 2 in FIG. 1 illustrates the absorption curve of the resulting sol. The F factor is 0.54. It may also be visually clearly seen that, upon diluting some of this dispersion, it is reddish-orange in colour.

Example 3

(Comparative Example)

The process is carried out as in Example 1, the sodium chloride being added, but a non-desalted gelatine having 0.6% of $Ca^{++}$ was used. The F factor was 0.25.

We claim:

1. A process for the production of a yellow silver sol prepared by reducing a water-soluble silver salt and precipitating the sol preparation and in the presence of a binder flocculating, washing and redispersing the preparation, wherein the improvement comprises in the presence of calcium-free gelatin flocculating and redispersing the sol, and adding to said sol preparation a water-soluble chloride selected from the group consisting of ammonium and alkali metal chlorides.

2. A process according to claim 1, wherein the improvement comprises the calcium-free gelatine is added in a quantity of from 30 g to 300 g per mol of silver nitrate during flocculation.

3. A process as claimed in claim 1 in which said water-soluble chloride is added not subsequent to said flocculating in a concentration of from 0.05 to 0.7 mole per mol of silver sol.

4. A process as claimed in claim 1 in which said water-soluble chloride is added not prior to the redispersion in a concentration of from $10^{-1}$ to $10^{-2}$ mole of chloride per mol of silver sol.

* * * * *